US007025139B2

(12) United States Patent
Khomynets

(10) Patent No.: US 7,025,139 B2
(45) Date of Patent: Apr. 11, 2006

(54) METHOD AND OPERATION OF A WELL JET DEVICE INKWELL TESTING AND DEVELOPMENT AND THE WELL JET DEVICE FOR CARRYING OUT SAID METHOD

(76) Inventor: Zinoviy Dmitrievich Khomynets, d.33, ul. Vilshanestkaya, Tismenitsa, obl. Ivano-Frankovskaya (UA) 77400

( * ) Notice: Subject to any disclaimer, the term of this patent is extended or adjusted under 35 U.S.C. 154(b) by 207 days.

(21) Appl. No.: 10/477,728

(22) PCT Filed: Apr. 24, 2002

(86) PCT No.: PCT/RU02/00193

§ 371 (c)(1),
(2), (4) Date: Nov. 14, 2003

(87) PCT Pub. No.: WO02/095238

PCT Pub. Date: Nov. 28, 2002

(65) Prior Publication Data

US 2004/0134653 A1 Jul. 15, 2004

(30) Foreign Application Priority Data

May 21, 2001 (RU) ..... 2001113318

(51) Int. Cl.
*E21B 43/00* (2006.01)

(52) U.S. Cl. ..... 166/259; 166/68; 175/424

(58) Field of Classification Search ..... 166/250.17, 166/259, 266, 68, 114, 177.6, 177.7, 222; 175/424

See application file for complete search history.

(56) References Cited

U.S. PATENT DOCUMENTS 4,293,283 A 10/1981 Roeder ..... 417/172

(Continued)

FOREIGN PATENT DOCUMENTS

RU 2121610 11/1998

(Continued)

*Primary Examiner*—Frank S. Tsay
(74) *Attorney, Agent, or Firm*—Dellett & Walters

(57) ABSTRACT

The invention relates to jet device used for extracting oil from wells. The inventive method consists in the following: a pump, a connecting and disconnecting unit, a valve unit, a packer and a shank are mounted on a tubing string before actuating the inventive device. A perforator is run into the well on a mounting seat in the pass channel of the pump, the packer being released. Differential pressure being produced, the perforator is blasted against the productive stratum which is then drained. The perforator being replaced by the transmitter and receiver-transducer of physical fields, the stratum is studied while the pump operates. Said transmitter and receiver-transducer being pulled from the well, a valve chamber and a blocking insert separating the cavity of the tubing string from environment are thrown into the well. The well starts to work in a natural flow regime. When the production rate decreases, the well is suspended, the blocking insert is substituted by a depression insert provided with a manometer and a debitometer and the well production is measured while fluids are pumped out. The flow rate-bottomhole pressure graph is plotted according to indications of instruments and interpreted, thereby defining the sizes of a pump. The required pump is run into the well along the tubing string and the well is put into operation by a power method. The invention is directed to improve reliability of the operation of said device.

2 Claims, 8 Drawing Sheets

U.S. PATENT DOCUMENTS

| | | | | | |
|---|---|---|---|---|---|
| 4,603,735 | A | * | 8/1986 | Black | 166/68 |
| 4,605,069 | A | * | 8/1986 | McClaflin et al. | 166/310 |
| 4,664,603 | A | * | 5/1987 | Priestly | 417/172 |
| 4,744,730 | A | | 5/1988 | Roeder | 417/172 |

FOREIGN PATENT DOCUMENTS

| | | |
|---|---|---|
| SU | 1146416 | 3/1985 |

* cited by examiner

METHOD AND OPERATION OF A WELL JET DEVICE INKWELL TESTING AND DEVELOPMENT AND THE WELL JET DEVICE FOR CARRYING OUT SAID METHOD

FIELD OF THE INVENTION

This invention relates to the field of pumping engineering, mainly to well jet devices used for oil production.

PRIOR ART

Known in the art is a method of operation of a well jet unit, including lowering in the well a tubing string with a jet pump, a packer and a perforator, arranging the said packer against a productive stratum and blasting the perforator, with the subsequently pumping a liquid working medium by the said jet pump (SU 1146416 A).

Known from the above source is a well jet unit comprising a jet pump arranged in the well on the piping string and a perforator arranged below the said jet pump.

The said unit enables to perforate the well and to pump a variety of produced media out of the well while intensifying the medium production; however, a strictly defined arrangement of the perforator relative to the jet pump does not enable, in a number of cases, the optimal positions of the perforator and the jet pump relative to the productive stratum which lowers the efficiency of the work on draining the well.

The closest, as to the technical essence and the achieved result, to the invention in the part of the method as the object of the invention is the method of operation of a well jet unit, which includes installation of a jet pump with a through passage and a packer onto the piping string, lowering of that assembly into the well, release of the packer and creation of the required pressure drawdown in the area below the packer by pumping the process fluid out of the area below the packer (RU 2121610 C1).

Known from the same patent is a well jet unit comprising a packer with the central passage and a jet pump with an active nozzle, the mixing chamber and the through passage having the mounting seat for installing a sealing assembly with the axial passage, all of them being installed onto the piping string, the said unit is provided with a transmitter and receiver-transducer of physical fields, which is arranged in the area below the packer on the side of entry of the pumped-out medium into the jet pump and installed on the well-logging cable passed through the axial passage of the sealing assembly, the output of the jet pump is connected to the area around the piping string, the input of the passage for supplying the pumped-out medium to the jet pump is connected to the inner cavity of the piping string below the sealing assembly, and the input of the passage for supplying the liquid working medium to the active nozzle is connected to the inner cavity of the piping string above the sealing assembly.

The said method of operation of the well jet unit and the unit for carrying out the said method enable to perform various production operations in the well below the level at which the jet pump is installed, including those performed by reducing pressure difference above and below the sealing assembly. But, the known unit does not enable to exploit its potential in full due to non-optimal arrangement and dimension relations of various structural elements of the well jet unit.

DISCLOSURE OF INVENTION

The objective of this invention is to optimize the arrangement and dimensions of various components of the construction of the well jet unit and, owing to it, to raise the reliability of its operation.

The stated objective in the part of the method is achieved owing to the fact that in the method of operation of the well jet unit in testing and developing wells, which includes installation of a jet pump with a through passage and a packer onto the piping string, lowering of that assembly into the well, release of the packer and creation of a required pressure drawdown in the area below the packer by pumping the process fluid out of the area below the packer with the jet pump, the piping string is additionally provided with: an assembly for disconnecting and connecting the piping string, a valve assembly with the mounting seat for installation of a check valve, a shank with an input cup, and a recirculation valve installed in the wall of the piping string above the jet pump; first the piping string is assembled by successively installing, top-down on the piping string, a jet pump, an assembly for disconnecting and connecting of the piping string, a valve assembly with the mounting seat for installing a check valve, a packer and a shank with an input cup; when lowering the assembly the packer is installed at least 50 meters above the roof of the productive stratum and the input cup is installed no more than 2 meters above the roof of that stratum; after releasing the packer a perforator on a well-logging cable is lowered into the well together with a sealing assembly installed thereon, which is seated onto the mounting seat in the through passage of the jet pump, the said perforator being arranged against the productive stratum; further a required pressure drawdown onto the stratum is created with the use of the jet pump, the perforator is blasted, and the stratum is drained until the process fluid under the packer is completely replaced by the stratum fluid; then the perforator together with the sealing assembly are lifted to the surface, a transmitter and receiver-transducer of physical fields with the sealing assembly are lowered into the well on the well-logging cable, and, while operating the jet pump, the stratum is explored in the area of perforation and the stratum fluid coming into the well; then the transmitter and receiver-transducer of physical fields together with the sealing assembly are lifted out of the well, a valve insert with a check valve, which is seated onto the mounting seat in the valve assembly, as well as a blocking insert with the bypass passage, which is seated onto the mounting seat in the valve assembly and separates the inner cavity of the piping string and the area around the piping string, are dropped into the well; thereafter a lightweight fluid or an inert gas is supplied to the area around the piping string through the recirculation valve, peening it into the inner cavity of the piping string, thus lowering the hydrostatic pressure in the well bottom zone; and the well is put into flowing operation, and after the well output is reduced due to the depletion of the stratum energy the well is deadened through the recirculation valve with a higher density fluid thus closing the check valve preventing the higher density fluid from entering into the area under the packer, the blocking insert is removed, a depression insert with an autonomous pressure gauge and a flowmeter is dropped into the piping string and the stratum fluid is pumped out of the well at different pressure drawdown by supplying the liquid working medium to the active nozzle of the jet pump, simultaneously measuring the well output at the surface and under the jet pump, then the depression insert with the autonomous pressure gauge and the flowmeter is removed out of the well, their readings of the bottom-hole pressures and flow rates are obtained, a flow rate vs. bottom-hole pressure data is plotted and by interpreting the plot the size of the pump required for forced oil production is determined; then, with the use of the assembly for disconnecting and connecting of the piping string, the jet pump with the above-arranged piping string is disconnected, lifted to the surface, an oil production pump of required capacity is lowered on the piping string and connected to the piping string part remaining in the well by using the assembly for disconnecting and connecting of the piping string, and the well is put into forced operation.

The stated objective in the part of the unit is achieved owing to the fact that the well jet unit comprises, being installed on the piping string, a packer and a jet pump with the active nozzle, the mixing chamber and the through passage with the mounting seat for installation of the sealing assembly with the axial passage, the said jet unit further comprises a transmitter and receiver-transducer of physical fields, which is arranged in the area below the packer on the side of entry of the pumped-out medium into the jet pump and installed on the well-logging cable fed through the axial passage of the sealing assembly, the output of the jet pump is connected to the area around the piping string, the input of the passage in the jet pump for supplying the pumped out medium is connected to the inner cavity of the piping string below the sealing assembly, and the input of the passage for supplying the working medium to the active nozzle is connected to the inner cavity of the piping string above the sealing assembly, further, according to the invention, the piping string is provided with a shank with the input cup, the valve assembly with the mounting seat for installing the valve insert with the check valve, the assembly for disconnecting and connecting the piping string, and the recirculation valve installed in the wall of the piping string above the jet pump; the packer is made with the central passage; the sealing assembly is installed with the possibility of being replaced by other functional inserts: a blocking insert, a pressurizing insert, a depression insert and an insert for recording stratum pressure restoration curves with the use of autonomous well gauges; the receiver-transducer of physical fields is made with the possibility of being replaced by a perforator or an instrument for acoustic impact on a stratum or strata; the above being taken into account, the diameter $D_{14}$ of the passage for supplying the working medium is not less than the inner diameter $D_{13}$ of the mixing chamber, the diameter $D_6$ of the through passage below the mounting seat is at least 0.7 mm less than its diameter $D_3$ above the mounting seat, the diameter $D_4$ of the sealing assembly is at least 1.4 mm less than the diameter $D_1$ of the inner cavity of the piping string, the diameter $D_5$ of the axial passage in the sealing assembly is at least 0.008 mm greater than the diameter $D_2$ of the well-logging cable, the diameter $D_{10}$ of the transmitter and receiver-transducer of physical fields is at least 1.4 mm less than the diameter $D_6$ of the through passage below the mounting seat, the diameter $D_9$ of the central passage in the packer is at least 1.4 mm greater than the diameter of the transmitter and transducer of physical fields, the diameter $D_8$ of the through passage in the valve assembly below the mounting seat for the valve insert is at least 0.7 mm less than its diameter $D_7$ above the mounting seat, the diameter $D_{16}$ of the valve insert with the check valve is at least 1 mm less than the diameter $D_6$ of the through passage in the jet pump under the mounting seat, the outer diameter $D_{15}$ of the jet pump is at least 2 mm less than the inner diameter $D_{11}$ of the casing string, the inner diameter $D_{13}$ of the mixing chamber is within 1.2 to 1.4 inner diameters $D_{12}$ of the nozzle, the distance $L_1$ between cross-sections of the nozzle and the mixing chamber is within 0.4 to 1.4 inner diameters $D_{12}$ of the nozzle, and the length $L_2$ of the sealing assembly is not less than its outer diameter $D_4$; the blocking insert has a bypass passage with the diameter $D_{17}$ being at least 20 mm and is provided with the head for the purpose of being removed out of the well, and the transmitter and receiver-transducer of physical fields are made with the possibility of being operated in the area under the packer both when the jet pump is operated and when it is shut down.

The functional analysis of the well jet unit has shown that the reliability of its operation may be increased both by optimizing the procedure of testing and developing wells and by optimizing the arrangement of the jet pump in its body and making various components of the unit under strictly defined dimensions.

It has been found that the above procedure enables to exploit the blast energy most effectively when carrying out works on intensifying oil inflow from the productive stratum, and that the conditions are created which prevent mud particles and other media from settling in the well after perforating it, which is achieved due to a pressure drawdown in the area under the packer. At a given pressure drawdown the jet pump removes the said particles and media from the productive stratum, and the transmitter and receiver-transducer of physical fields is used for well exploration or for impacting a stratum or strata by physical fields. At the same time the possibility exists for controlling the pressure drawdown value by controlling the pumping rate of the liquid working medium. Moreover, when testing strata it is possible to adjust the pumping-out mode through changing the pressure of the liquid working medium supplied to the nozzle of the jet pump. In the course of exploration it is possible to move the transmitter and receiver-transducer of physical fields along the well, and exploration may be conducted both when the jet pump is operated and when it is shut down. Covering both the passage for supplying the liquid working medium and the passage for supplying the pumped-out medium with the blocking insert enables to prevent foreign objects that may clog the jet pump from entering into it, which also enables to improve the reliability of the unit. The check valve, which is installed in the piping string below the jet pump, enables to prevent the products of stratum perforation from entering the well when stopping works in the well, e.g., at equipment changes. Moreover, it enables to measure the well parameters more accurately which enables to conduct more qualitative processing of the well and prepare it for exploitation. The recirculation valve installed in the wall of the piping string enables to change the medium in the piping string and regulate the hydrostatic pressure in the well bottom zone. Thus, this working method enables high-quality development of wells after drilling, their comprehensive exploration and testing in various modes.

It has been found during the studies that the diameter of the passage for supplying the liquid working medium may not be chosen arbitrarily. It is due to the fact that an excessively large diameter of the said passage results in lowering the durability of the unit while an excessively low diameter reduces the capacity of the jet pump. It has been found out in this connection that if the diameter of the passage for supplying the liquid working medium is made not less than the inner diameter of the mixing chamber and the inner diameter of the mixing chamber is made within 1.2 to 1.4 inner diameters of the nozzle and the distance between sections of the nozzle and the mixing chamber is made within 0.4 to 1.4 inner diameters of the nozzle, then it enables to ensure the supply of required quantities of the liquid working medium to the nozzle of the jet pump and ensure the maximum possibly capacity of the jet pump while achieving the necessary strength of the jet pump body; it has been also found that if the diameter of the through passage below the mounting seat is made at least 0.7 mm less than its diameter above the mounting seat, then it enables to ensure tight installation of the sealing assembly and other inserts, e.g. the blocking insert, at the mounting seat, which prevents the medium from flowing along the wall of the insert installed on the mounting seat. The upper limit is defined by the structural features of the mounting seat and the dimensions of the well. If the diameter of the sealing assembly is made at least 1.4 mm less than the diameter of the inner cavity of the piping string, then it enables to avoid possible sticking of the insert when being lowered and installed onto the mounting seat. As has been said, in the process of operating the unit it is necessary to move the instruments and equipment installed on the cable along the well and, at the same time, to minimize flow of the medium through the axial passage of the sealing assembly. It has been achieved after making the diameter of the axial passage in the sealing assembly at least 0.008 mm greater than the diameter of the cable on which the instruments and equipment are installed. It has been found that if the diameter of the transmitter and receiver-transducer of physical fields and the diameter of the perforator are made at least 1.4 mm less than the diameter of the through passage below the mounting seat as well as is the diameter of the central passage in the packer is made at least 1.4 mm greater than the diameter of the transmitter and transducer of physical fields and the diameter of the perforator and the diameter of the valve insert with the check valve is made at least 1 mm less than the diameter of the through passage of the jet pump under the mounting seat, then it enables to avoid sticking of the transmitter and receiver-transducer of physical fields and the perforator of the valve insert when installing them and moving along the piping string. If the diameter of the through passage in the valve assembly below the mounting seat for the valve insert is made at least 0.7 mm less than its diameter above the mounting seat, then it enables to ensure tight installation of the valve insert with the check valve on the mounting seat while avoiding overflow of the medium from the well space above the check valve. If the outer diameter of the jet pump is made at least 2 mm less than the inner diameter of the casing string, then it enables to pass the maximum quantity, which is based on the pump capacity, of the pumped out medium through the jet pump with minimum hydraulic losses. As to the upper limit, it is determined by the strength characteristics of the jet pump construction, principally by those of the jet pump body, and the permissible minimum values of the inner diameter of the piping string. The length of the sealing assembly should not be less than its outer diameter. It eliminates misalignment when installing the sealing assembly onto the mounting seat and, consequently, prevents the medium from flowing along the wall of the sealing assembly and prevents the assembly from sticking in the process of its installation and removal. The blocking insert should have the bypass passage with the diameter at least 20 mm and should be provided with the head for removing it out of the well. If the bypass passage is made with the diameter less than 20 mm, excessive hydraulic resistance occurs, which sharply reduces the work efficiency when testing and developing wells in a number of cases it intensifies the process of clogging the bypass passage, which results in work stoppage at the well.

Thus, the above-described totality of interdependent parameters and the sequence of operations ensure the achievement of the invention objective—to optimize the method of operation of a well jet unit when testing and developing wells, the arrangement and the dimensions of various components of the unit, and, thus, to raise the reliability of operation of the well jet unit.

DESCRIPTION OF THE PREFERRED EMBODIMENT

Figure 1:
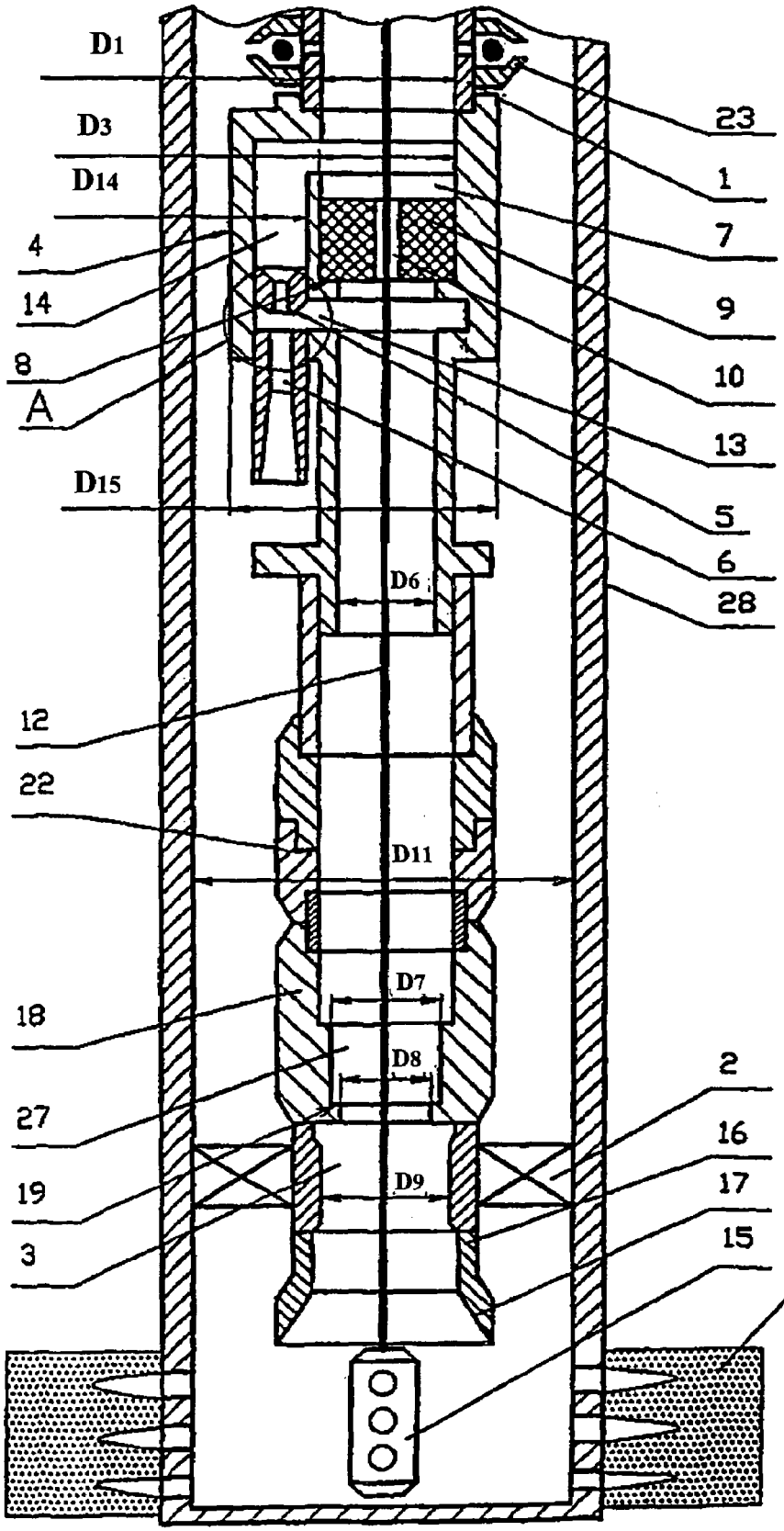
FIG. 1 is a longitudinal section of the unit with the sealing assembly and the perforator installed thereon.
Figure 2:
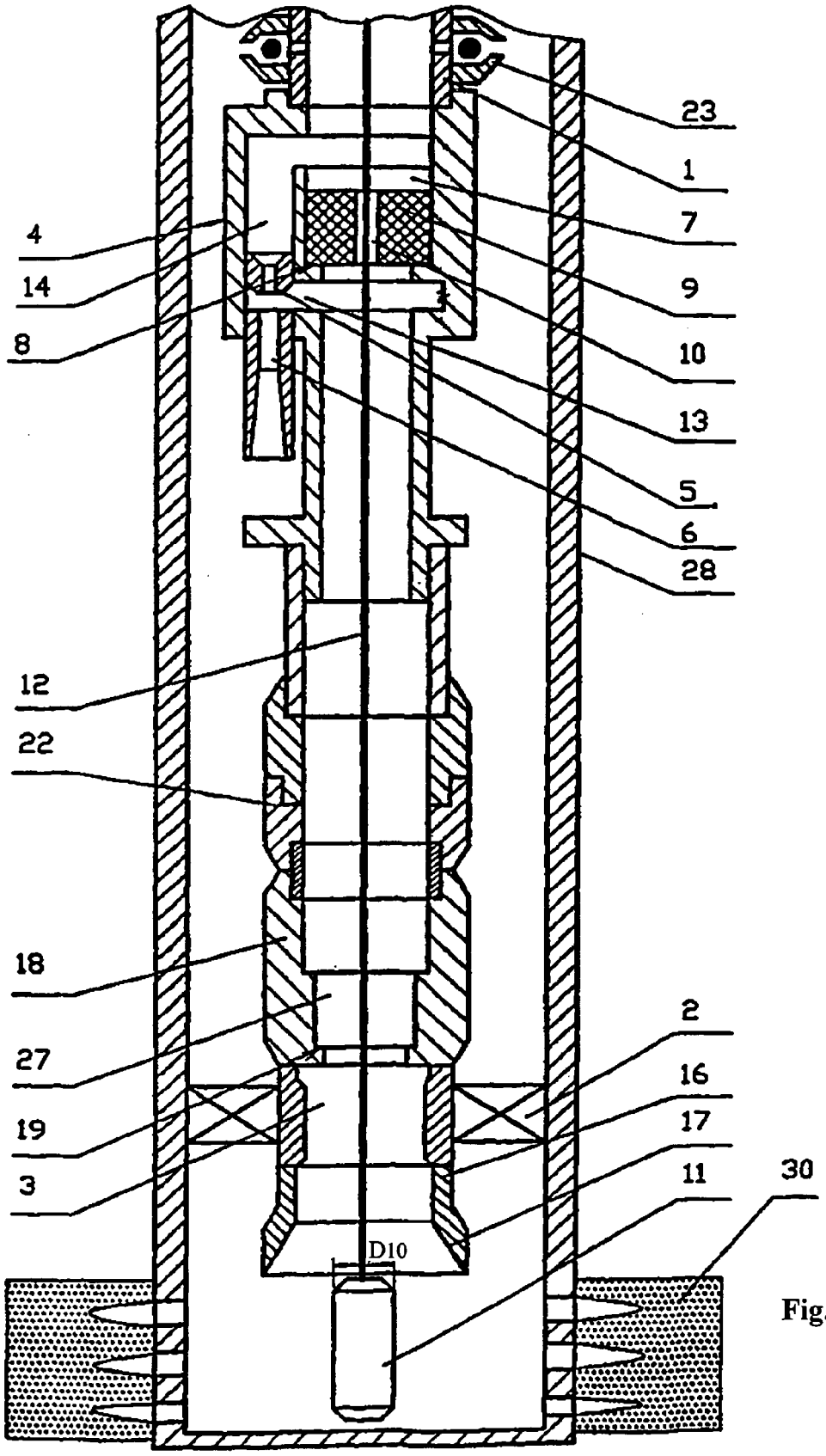
FIG. 2 is a longitudinal section of the unit with the sealing assembly, the transmitter and receiver-transducer of physical fields installed thereon.
Figure 3:
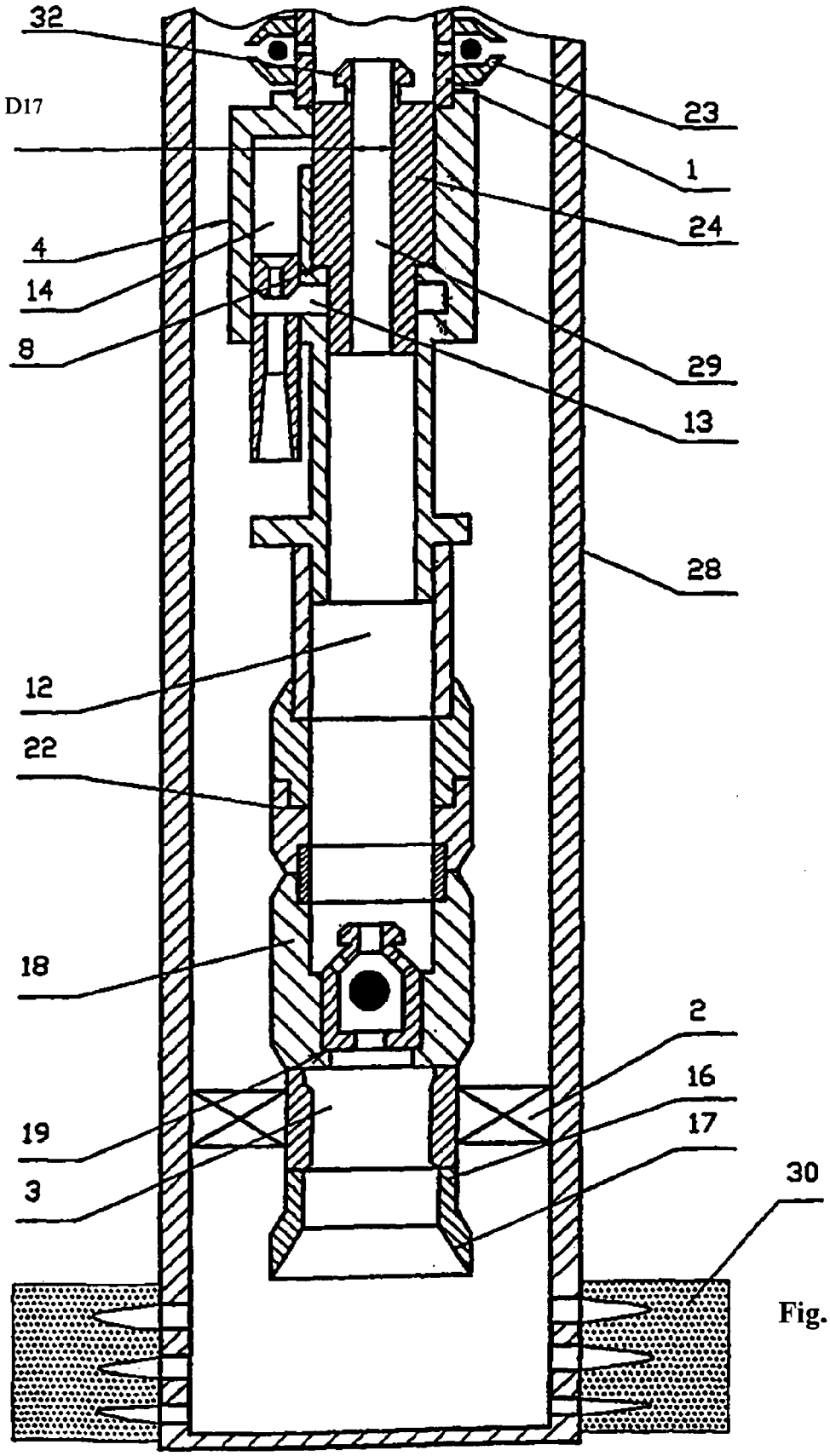
FIG. 3 is a longitudinal section of the unit with the blocking insert installed thereon.
Figure 4:
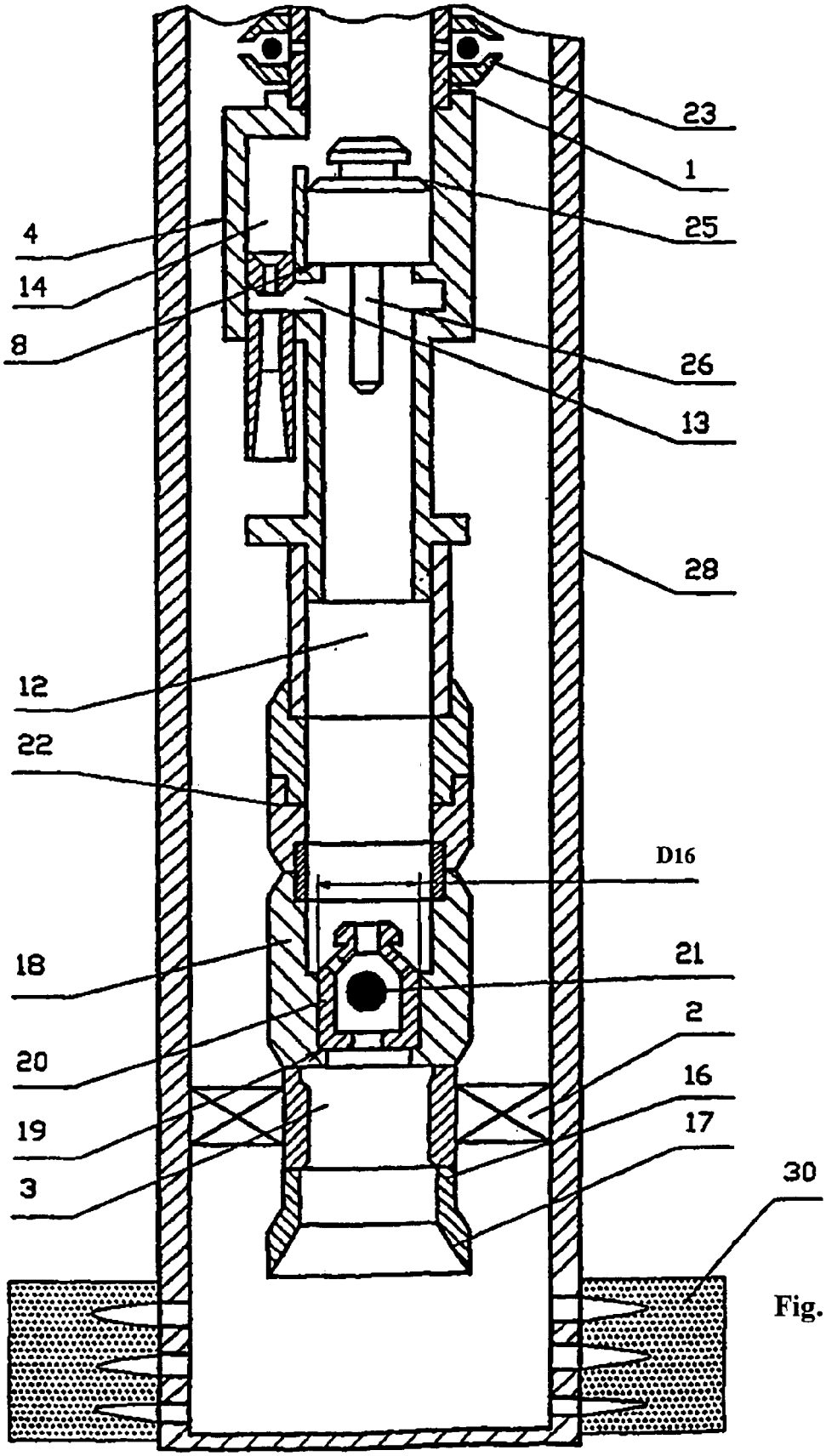
FIG. 4 is a longitudinal section of the unit with the installed depression insert with the autonomous pressure gauge and the flowmeter and the valve insert.
Figure 5:
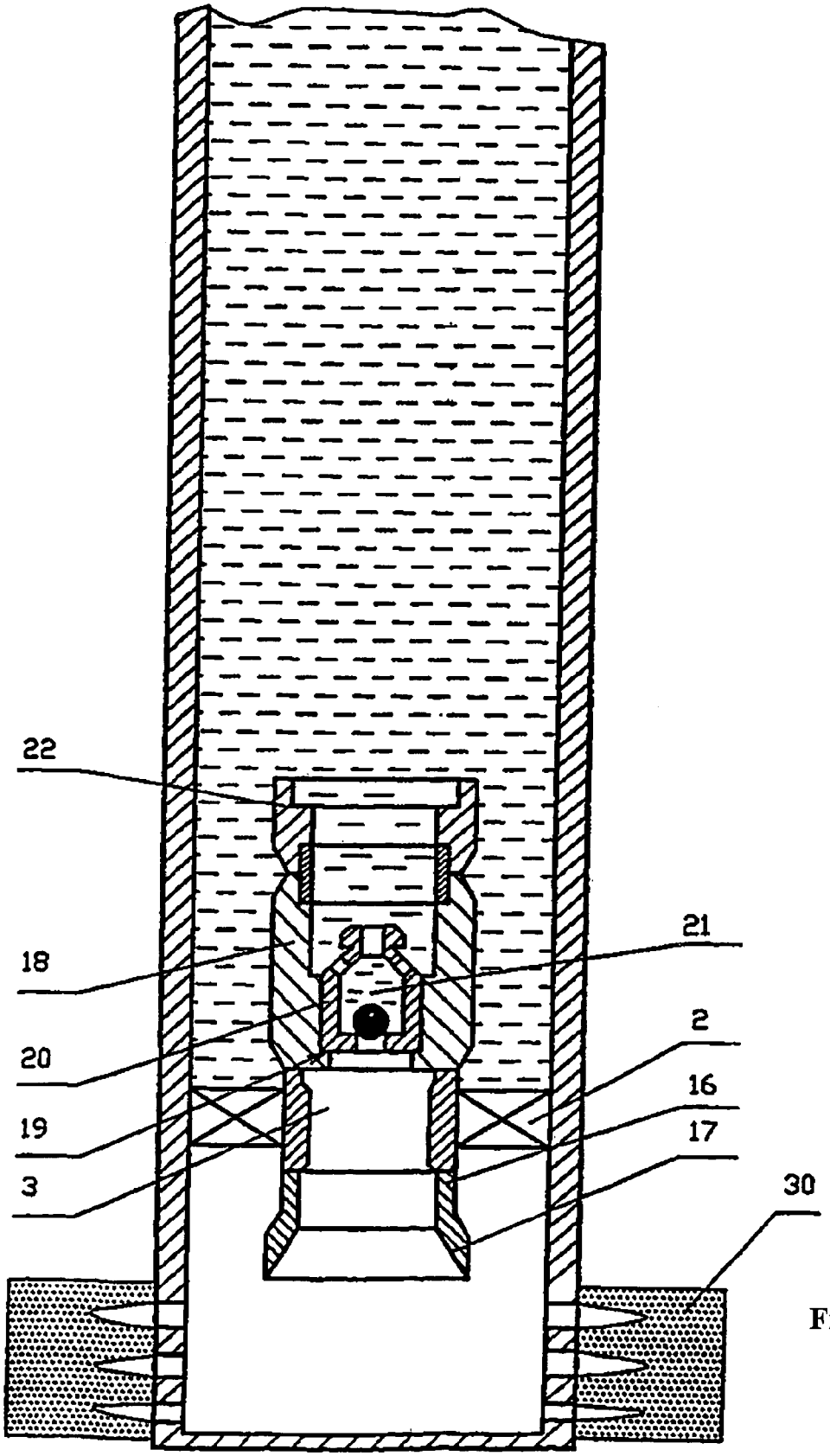
FIG. 5 is a longitudinal section of the unit with the lifted piping string with the jet unit.
Figure 6:
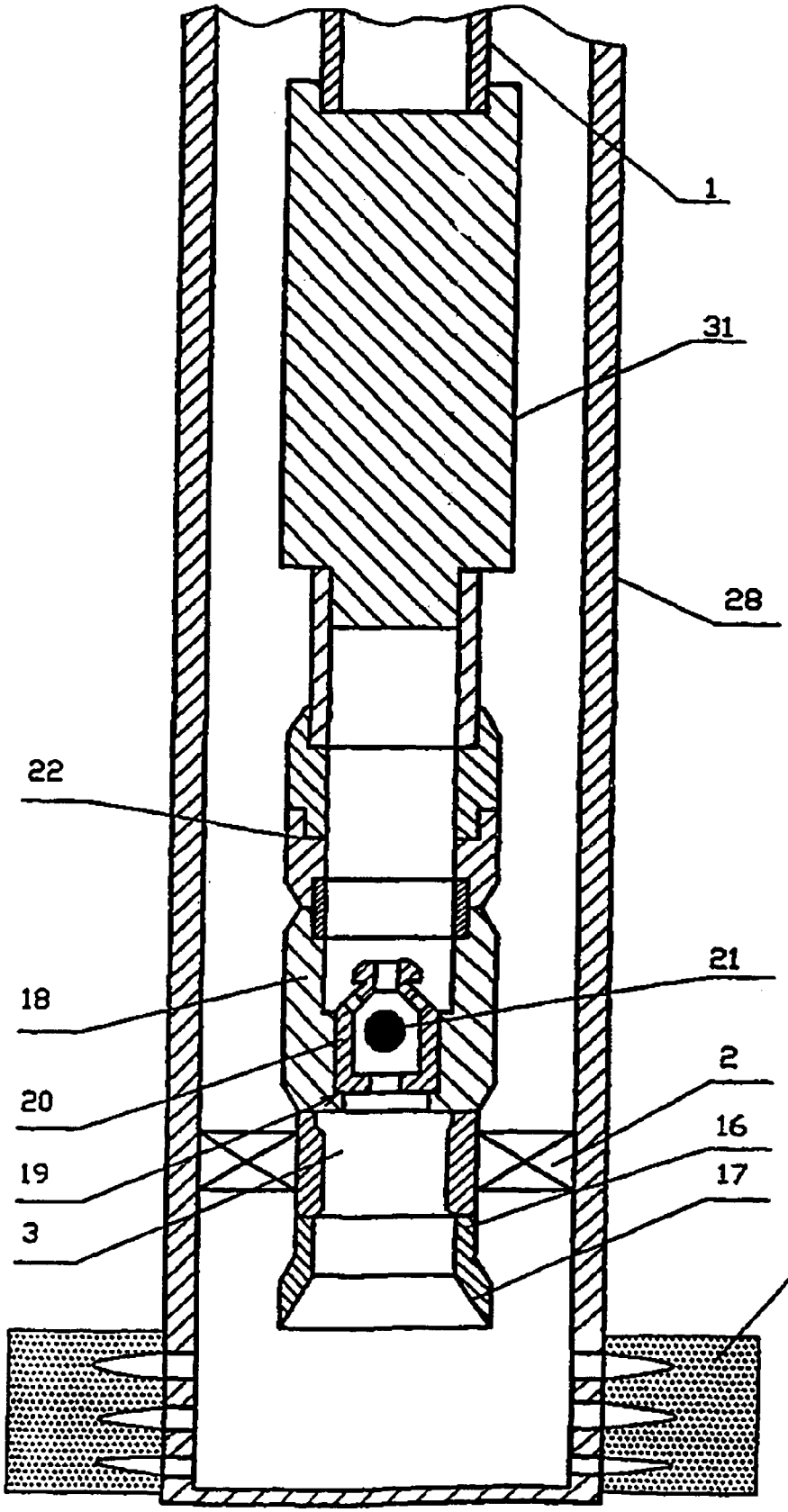
FIG. 6 is a longitudinal section of the unit with the installed oil production pump.
Figure 7:
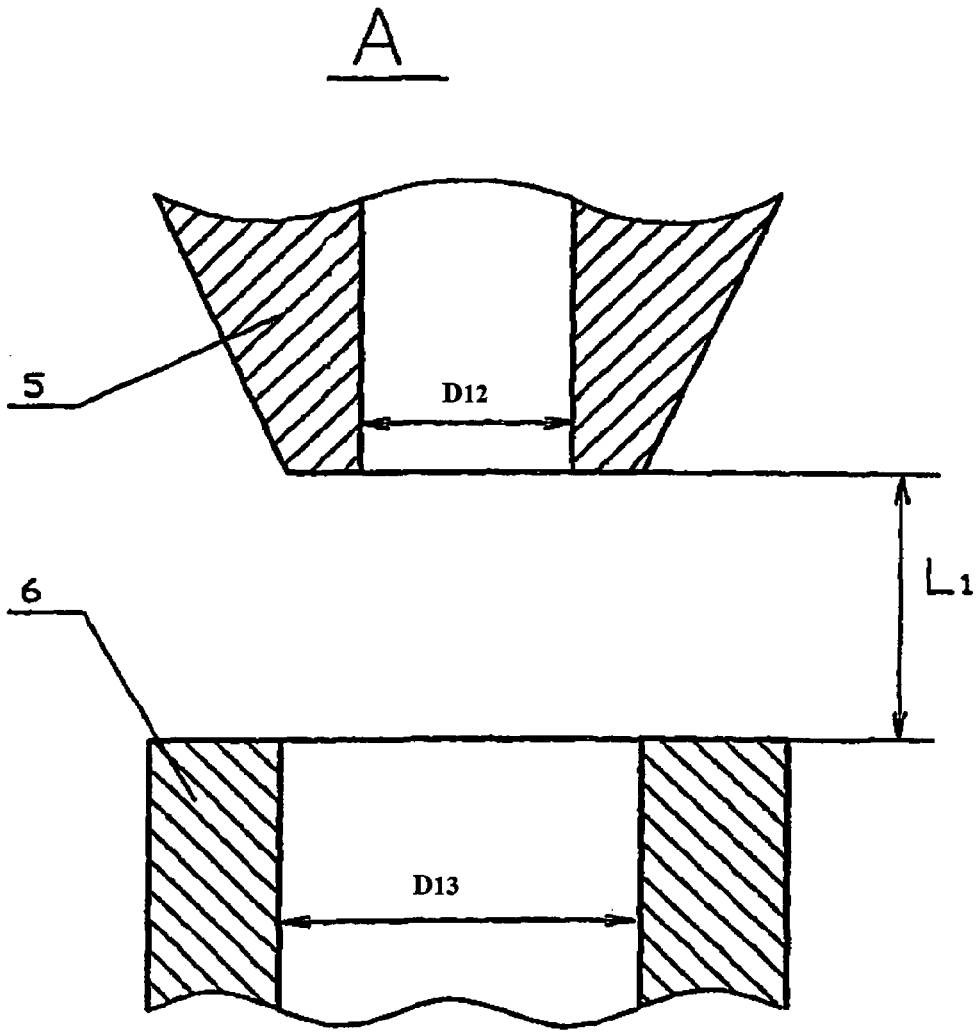
FIG. 7 is the portion A from FIG. 1.
Figure 8:
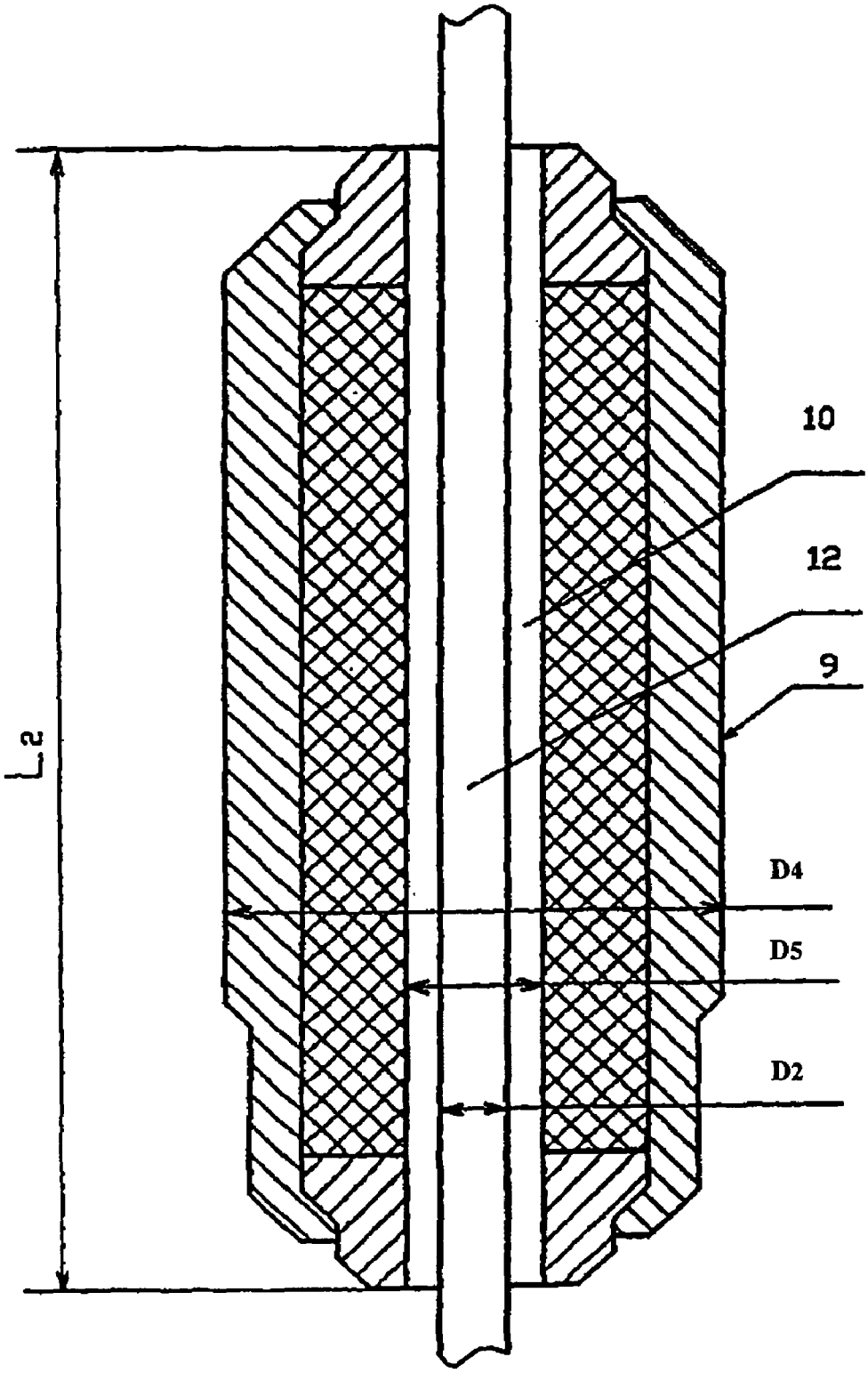
FIG. 8 is a longitudinal section of the sealing assembly.

The well jet unit comprises installed on the piping string 1 the packer 2 with the central passage 3 and the jet pump 4 with the active nozzle 5, the mixing chamber 6 and the through passage 7 with the mounting seat 8 for installation of the sealing assembly 9 with the axial passage 10, the said unit further comprises the transmitter and receiver-transducer of physical fields 11, which is arranged in the area below the packer on the side of entry of the pumped-out medium into the jet pump 4 and installed on the well-logging cable 12 fed through the axial passage 10 of the sealing assembly 9. The output of the jet pump 4 is connected to the area around the piping string 1, the input side of the passage 13 in the jet pump 4 for supplying the working medium is connected to the inner cavity of the piping string 1 below the sealing assembly 9, and the input side of the passage 14 for supplying the liquid working medium to the active nozzle 5 is connected to the inner cavity of the piping string 1 above the sealing assembly 9. The unit is made with the possibility of installing the perforator onto the well-logging cable 12. The piping string 1 is provided with a shank 16 with the input cup 17, the valve assembly 18 with the mounting seat 19 for installing the valve insert 20 with the check valve 21, the assembly 22 for disconnecting and connecting the piping string 1, and the recirculation valve 23 installed in the wall of the piping string above the jet pump 4; the sealing assembly 9 is installed with the possibility of being replaced by other functional inserts: the blocking insert 24, the pressurizing insert, the depression insert 25 and the insert for recording stratum pressure restoration curves with the use of autonomous well gauges, e.g., the depression insert 25 is made with the autonomous well gauges 26, namely, the pressure gauge and the flowmeter, the transmitter and receiver-transducer of physical fields 11 is made with the possibility of being replaced by the perforator 15 or an instrument for acoustic impact on a stratum or strata; the above being taken into account, the diameter $D_{14}$ of the passage 14 for supplying the working medium is not less than the inner diameter $D_{13}$ of the mixing chamber 6, the diameter $D_6$ of the through passage 7 below the mounting seat 8 is at least 0.7 mm less than its diameter $D_3$ above the mounting seat 8, the diameter $D_4$ of the sealing assembly 9 is at least 1.4 mm less than the diameter $D_1$ of the inner cavity of the piping string 1, the diameter $D_5$ of the axial passage 10 in the sealing assembly 9 is at least 0.008 mm greater than the diameter $D_2$ of the well-logging cable 12, the diameter $D_{10}$ of the transmitter and receiver-transducer of physical fields 11 is at least 1.4 mm less than the diameter $D_6$ of the through passage 7 below the mounting seat 8, the diameter $D_9$ of the central passage 3 in the packer 2 is at least 1.4 mm greater than the diameter of the transmitter and transducer of physical fields 11, the diameter $D_8$ of the through passage 27 in the valve assembly 18 below the mounting seat 19 for the valve insert 20 is at least 0.7 mm less than its diameter $D_7$ above the mounting seat 19, the diameter $D_{16}$ of the valve insert 20 with the check valve 21 is at least 1 mm less than the diameter $D_6$ of the through passage 7 in the jet pump 4 under the mounting seat 8, the outer diameter $D_{15}$ of the jet pump 4 is at least 2 mm less than the inner diameter $D_{11}$ of the casing string 28, the inner diameter $D_{13}$ of the mixing chamber 6 is within 1.2 to 1.4 inner diameters $D_{12}$ of the nozzle 5, the distance $L_1$ between cross-sections of the nozzle 5 and the mixing chamber 6 is within 0.4 to 1.4 inner diameters $D_{12}$ of the nozzle 5, and the length $L_2$ of the sealing assembly 9 is not less than its outer diameter $D_4$; the blocking insert 24 has a bypass passage 29 with the diameter $D_{17}$ being at least 20 mm and is provided with the head 32 for the purpose of being removed out of the well, and the transmitter and receiver-transducer of physical fields 11 are made with the possibility of being operated in the area under the packer both when the jet pump 4 is operated and when it is shut down.

The method of operation of the well jet unit when testing and developing wells is implemented as follows.

First, the piping string 1 is assembled by successively installing, top-down on the piping string 1, the jet pump 4, the assembly 22 for disconnecting and connecting of the piping string 1, the valve assembly 18 with the mounting seat 19 for installing the check valve 21, the packer 2 with the central passage 3 and the shank 16 with the input cup 17. Then, the whole assembled unit is lowered in the well and the packer is released; when lowering, the packer 2 being installed at least 50 meters above the roof of the productive stratum 30, and the input cup 17 being installed no more than 2 meters above the roof of that stratum 30. After releasing the packer 2, the perforator 15 on the well-logging cable 12 is lowered into the well together with the sealing assembly 9 installed above it, the sealing assembly 9 being seated onto the mounting seat 8 in the through passage 7 of the jet pump 4, the perforator 15 being arranged against the productive stratum 30; then a required pressure drawdown onto the stratum is created, the perforator 15 is blasted, and the stratum is drained, e.g. for a long time, until the process fluid under the packer 2 is completely replaced by the stratum fluid by supplying the liquid working medium to the nozzle 5 of the jet pump 4 and pumping out the process fluid from the area under the packer 2 with the jet pump 4, thus creating a pressure drawdown, as necessary for pumping out the process fluid, in the area under the packer 2. Then the perforator 15 together with the sealing assembly 9 are lifted to the surface, and the transmitter and receiver-transducer of physical fields 11 with the sealing assembly 9 are lowered into the well on the well-logging cable 12. Explorations of the stratum 30 in the area of perforation and the stratum fluid coming into the well are carried out when the jet pump 4 is operated. Then the transmitter and receiver-transducer of physical fields 11 together with the sealing assembly 9 are lifted out of the well, and the valve insert 20 with the check valve 21, which is seated onto the mounting seat 19 in the valve assembly 18, as well as the blocking insert 24 with the bypass passage 29, which is seated onto the mounting seat 8 in the through passage 7 of the jet pump 4, are dropped into the well. The blocking insert 24 separates the inner cavity of the piping string 1 and the area around the piping string 1. By supplying a lightweight fluid or an inert gas to the area around the piping string 1 through the recirculation valve it is peened into the inner cavity of the piping string 1, thus lowering the hydrostatic pressure in the well bottom zone, and this enables to put the well into flowing operation. After the well output is reduced due to the depletion of the energy of the stratum 30, the well is deadened through the recirculation valve(s) 23 with a higher density fluid thus closing the check valve 21 preventing the higher density fluid from entering into the area under the packer and contaminating the stratum 30. Then the blocking insert 24 is removed, the depression insert 25 with the autonomous gauges 26 is dropped into the piping string 1. In this case the gauges are a pressure gauge and a flowmeter. By supplying the liquid working medium to the active nozzle 5 of the jet pump 4 the stratum fluid is pumped out of the well at different pressure drawdown, simultaneously the well output at the surface and under the jet pump 4 is measured, after which the depression insert 25 with the autonomous pressure gauge and the flowmeter is removed, their readings of the bottom-hole pressures and flow rates are obtained, and a flow rate vs. bottom-hole pressure data is plotted. By interpreting the obtained measurements the size of the pump 31 required for forced oil production is determined. Then, with the use of the assembly 22 for disconnecting and connecting of the piping string 1, the jet pump 4 and the above-arranged piping string 1 are disconnected, lifted to the surface, and the oil production pump 31 of required capacity is lowered on the piping string 1 and connected to the part, which remained in the well, of the piping string 1, using the assembly 22 for disconnecting and connecting of the piping string 1, and the well is put into forced operation.

INDUSTRIAL APPLICABILITY

This invention may be utilized in the oil industry in testing and developing wells, and in other industries where various media are extracted from wells.

What is claimed is:

1. The method of operation of the well jet unit in testing and developing wells, which includes installation of a jet pump with a through passage and a packer onto the piping string, lowering of that assembly into the well, release of the packer and creation of a required pressure drawdown in the area below the packer by pumping the process fluid out of the area below the packer with the jet pump, characterized in that the piping string is additionally provided with: an assembly for disconnecting and connecting the piping string, a valve assembly with a mounting seat for installation of a check valve, a shank with an input cup, and a recirculation valve installed in the wall of the piping string above the said jet pump; first the piping string is assembled by successively installing, top-down on the piping string, a jet pump, an assembly for disconnecting and connecting of the piping string, a valve assembly with the mounting seat for installing a check valve, a packer and a shank with an input cup; when lowering the assembly the packer is installed at least 50 meters above the roof of the productive stratum and the input cup is installed no more than 2 meters above the roof of that stratum, after releasing the packer a perforator on a well-logging cable is lowered into the well together with a sealing assembly installed thereon which is seated onto the mounting seat in the through passage of the jet pump, the said perforator being arranged against the productive stratum, further a required pressure drawdown onto the stratum is created with the use of the jet pump, the perforator is blasted, and the stratum is drained until the process fluid under the packer is completely replaced by the stratum fluid; then the perforator together with the sealing assembly are lifted to the surface, a transmitter and receiver-transducer of physical fields with the sealing assembly are lowered into the well on the well-logging cable, a valve insert with a check valve, which is seated onto the mounting seat in the through passage in the valve assembly, as well as a blocking insert with the bypass passage, which is seated onto the mounting seat in the valve assembly and separates the inner cavity of the piping string and the area around the piping string, are dropped into the well; thereafter a lightweight fluid or an inert gas is supplied to the area around the piping string through the recirculation valve, peening it into the inner cavity of the piping string, thus lowering the hydrostatic pressure in the well bottom zone; and the well is put into flowing operation, and after the well output is reduced due to the depletion of the stratum energy the well is deadened through the recirculation valve with a higher density fluid thus closing the check valve preventing the higher density fluid from entering into the area under the packer, the blocking insert is removed, a depression insert with an autonomous pressure gauge and a flowmeter is dropped into the piping string, and the stratum fluid is pumped out of the well at different pressure drawdown by supplying the liquid working medium to the active nozzle of the jet pump, simultaneously measuring the well output at the surface and under the jet pump, then the depression insert with the autonomous pressure gauge and the flowmeter is removed out of the well, their readings of the bottom-hole pressures and flow rates are obtained, a flow rate vs. bottom-hole pressure data is plotted and by interpreting the plot the size of the pump required for forced oil production is determined; then, with the use of the assembly for disconnecting and connecting of the piping string, the jet pump with the above-arranged piping string is disconnected, lifted to the surface, an oil production pump of required capacity is lowered on the piping string and connected to the piping string part remaining in the well by using the assembly for disconnecting and connecting of the piping string, and the well is put into forced operation.

2. The well jet unit, which comprises, being installed on the piping string, a packer and a jet pump with the active nozzle, the mixing chamber and the through passage with the mounting seat for installation of the sealing assembly with the axial passage, the said jet unit further comprises a transmitter and receiver-transducer of physical fields, which is arranged in the area below the packer on the side of entry of the pumped-out medium into the jet pump and installed on the well-logging cable fed through the axial passage of the sealing assembly, the output of the jet pump is connected to the area around the piping string, the input of the passage in the jet pump for supplying the pumped out medium is connected to the inner cavity of the piping string below the sealing assembly, and the input of the passage for supplying the working medium to the active nozzle is connected to the inner cavity of the piping string above the sealing assembly, characterized in that the piping string is provided with a shank with the input cup, the valve assembly with the mounting seat for installing the valve insert with the check valve, the assembly for disconnecting and connecting the piping string, and the recirculation valve installed in the wall of the piping string above the jet pump; the packer is made with the central passage; the sealing assembly is installed with the possibility of being replaced by other functional inserts: a blocking insert, a pressurizing insert, a depression insert and an insert for recording stratum pressure restoration curves with the use of autonomous well gauges; the receiver-transducer of physical fields is made with the possibility of being replaced by a perforator or an instrument for acoustic impact on a stratum or strata; the above being taken into account, the diameter $D_{14}$ of the passage for supplying the working medium is not less than the inner diameter $D_{13}$ of the mixing chamber, the diameter $D_6$ of the through passage below the mounting seat is at least 0.7 mm less than its diameter $D_3$ above the mounting seat, the diameter $D_4$ of the sealing assembly is at least 1.4 mm less than the diameter $D_1$ of the inner cavity of the piping string, the diameter $D_5$ of the axial passage in the sealing assembly is at least 0.008 mm greater than the diameter $D_2$ of the well-logging cable, the diameter $D_{10}$ of the transmitter and receiver-transducer of physical fields is at least 1.4 mm less than the diameter $D_6$ of the through passage below the mounting seat, the diameter $D_9$ of the central passage in the packer is at least 1.4 mm greater than the diameter of the transmitter and transducer of physical fields, the diameter $D_8$ of the through passage in the valve assembly below the mounting seat for the valve insert is at least 0.7 mm less than its diameter $D_7$ above the mounting seat, the diameter $D_{16}$ of the valve insert with the check valve is at least 1 mm less than the diameter $D_6$ of the through passage in the jet pump under the mounting seat, the outer diameter $D_{15}$ of the jet pump is at least 2 mm less than the inner diameter $D_{11}$ of the casing string, the inner diameter $D_{13}$ of the mixing chamber is within 1.2 to 1.4 inner diameters $D_{12}$ of the nozzle, the distance $L_1$ between cross-sections of the nozzle and the mixing chamber is within 0.4 to 1.4 inner diameters $D_{12}$ of the nozzle, and the length $L_2$ of the sealing assembly is not less than its outer diameter $D_4$; the blocking insert has a bypass passage with the diameter $D_{17}$ being at least 20 mm and is provided with the head for the purpose of being removed out of the well, and the transmitter and receiver-transducer of physical fields are made with the possibility of being operated in the area under the packer both when the jet pump is operated and when it is shut down.

* * * * *